US007588142B1

(12) United States Patent
Bush

(10) Patent No.: US 7,588,142 B1
(45) Date of Patent: Sep. 15, 2009

(54) ADDITIVE DELIVERY SYSTEM CLOSURE

(75) Inventor: Randall G. Bush, Evansville, IN (US)

(73) Assignee: Rexam Closures and Containers Inc., Evansville, IN (US)

( * ) Notice: Subject to any disclaimer, the term of this patent is extended or adjusted under 35 U.S.C. 154(b) by 566 days.

(21) Appl. No.: 11/283,601

(22) Filed: Nov. 18, 2005

(51) Int. Cl.
*B65D 25/08* (2006.01)

(52) U.S. Cl. ..... 206/221; 215/DIG. 8

(58) Field of Classification Search ..... 206/219–221, 206/568; 215/DIG. 8
See application file for complete search history.

(56) References Cited

U.S. PATENT DOCUMENTS

| | | | | |
|---|---|---|---|---|
| 1,464,273 | A | 8/1923 | Schopflocher | |
| 2,533,806 | A | 12/1950 | Holzapfel | |
| 3,326,400 | A * | 6/1967 | Hamelin et al. | 206/221 |
| 3,425,598 | A | 2/1969 | Kobernick | |
| 4,024,952 | A * | 5/1977 | Leitz | 206/221 |
| 4,195,730 | A | 4/1980 | Hunt | |
| 4,221,291 | A | 9/1980 | Hunt | |
| 4,386,696 | A | 6/1983 | Goncalves | |
| 4,580,682 | A | 4/1986 | Gorski et al. | |
| 4,785,859 | A | 11/1988 | Gustavsson et al. | |
| 4,903,865 | A | 2/1990 | Janowitz | |
| 5,950,819 | A | 9/1999 | Sellars | |
| 5,967,309 | A * | 10/1999 | Robles-Gonzalez et al. | 206/221 |
| 5,975,369 | A | 11/1999 | Yurkewicz et al. | |
| 6,491,041 | B1 | 12/2002 | Okamoto | |
| 6,527,110 | B2 | 3/2003 | Moscovitz | |
| 6,843,368 | B1 | 1/2005 | Frutin | |
| 6,854,595 | B2 | 2/2005 | Kiser | |
| 6,921,087 | B2 * | 7/2005 | Takahashi et al. | 206/221 |
| 7,083,043 | B2 * | 8/2006 | Sharon | 206/221 |
| 2004/0149599 | A1 | 8/2004 | Cho | |
| 2004/0159562 | A1 | 8/2004 | Takahashi et al. | |
| 2004/0226835 | A1 | 11/2004 | Takahashi et al. | |

FOREIGN PATENT DOCUMENTS

| | | |
|---|---|---|
| GB | 2220930 | 1/1990 |
| GB | 2279057 | 12/1994 |

* cited by examiner

*Primary Examiner*—Luan K Bui
(74) *Attorney, Agent, or Firm*—John F. Salazar; Middleton Reutlinger

(57) ABSTRACT

A closure is described which incorporates an additive delivery system integral with the closure. The system includes a dosing chamber formed in the closure, the dosing chamber exhausting the contents into the container upon initial unthreading of the closure from the container. The design prevents premature dosing of the chamber into the container and also allows the dosing chamber to be pressurized if so desired.

17 Claims, 6 Drawing Sheets

ADDITIVE DELIVERY SYSTEM CLOSURE

BACKGROUND OF THE INVENTION

The present invention is directed towards an additive delivery system within a closure which works to deliver contents contained within a dosing chamber into a container on which the closure is placed upon first removal of the closure.

DETAILED DESCRIPTION OF THE PREFERRED EMBODIMENTS

Figure 1:
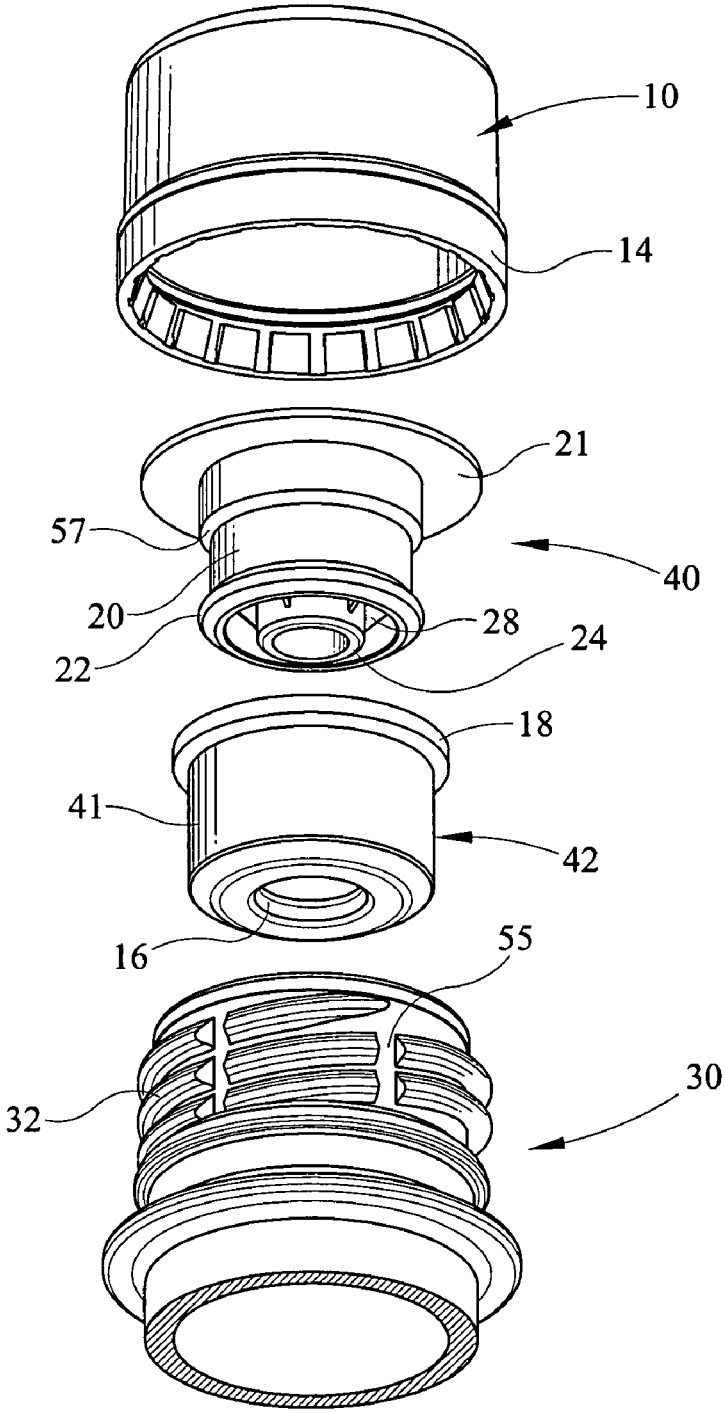
FIG. 1 is a component view of each element of the additive delivery system closure of the present invention shown in exploded view.
Figure 2:
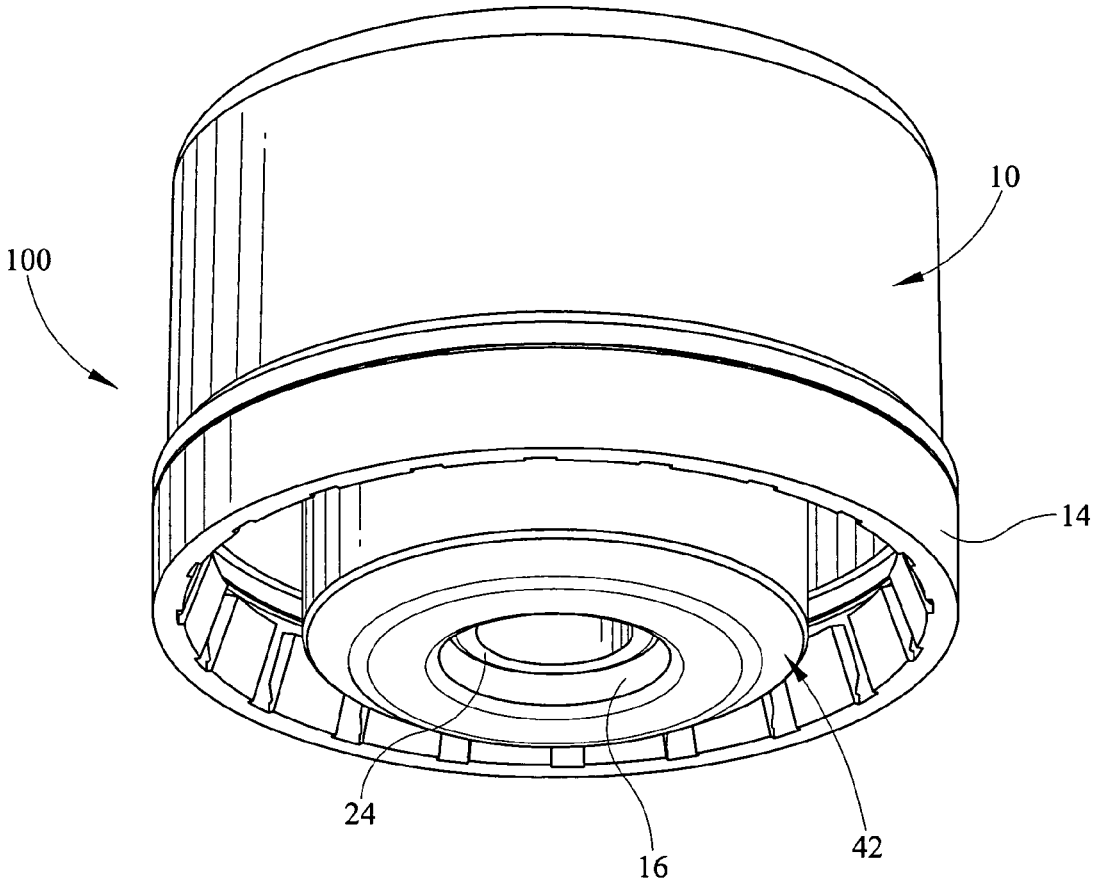
FIG. 2 is an assembled perspective view of the combined closure of the present invention.

Referring to both FIG. 1 and FIG. 2, an additive delivery system closure 100 is shown. The additive delivery system closure 100 of the present invention is utilized to provide dosing of a liquid or other additive held within a dosing chamber of the closure into the container contents upon initial removal of the closure from the container.

It may be very desirable to keep certain additives from the contents of the container separate until initial opening of the container due to degradation of the additive, effects the container contents may have on the additive or other reasons. In such instances, mixing of the additive contents with the container contents may be accomplished only upon initial opening of the container. It is further desirable that injection of the additive contents to the container occur upon normal container opening movements, not requiring additional steps forcing or injecting the additive material into the container. As such, the present additive delivery system closure 100 works to inject the contents of the dosing chamber into the container directly upon unthreading of the closure from the container in standard fashion.

Such additive delivery system closures may be especially useful in carbonated beverage containers due to the acidity levels of the container contents and the degradation effect such levels have on the additive or flavoring components. In such instance, pressure generated from the carbonated beverage contents can be utilized to maintain separation of the additive and the container and its contents. The chamber of the container may be pressurized by the contents of the container and the design of the additive delivery system closure of the present invention may include means by which the dosing chamber is also pressurized after capping by contents of the container through small vent holes or similar structures.

Returning to both FIG. 1 and FIG. 2, the additive delivery system closure 100 of the present invention is depicted as can be installed on a container neck 30. The combined closure 100 is depicted in FIG. 1 as being a three pieced closure which includes the closure 10, an insert 40 received within the closure and an injection button 42 which slides over the insert and is retained thereon. Reviewing these figures in conjunction with FIG. 3, a dosing chamber 12 is provided in the interior cavity defined by the insert 40. The insert 40 has an annular depending side wall 20 which depends from an insert top wall 21, the insert top wall adjacent to the inner top wall of the closure 10.

The annular side wall 20 serves as the support for ribs 28 which suspend interiorly of the side wall 20 a center ceiling plug 24. The insert 40 and the insert side wall 20 forms interiorly thereof a dispensing chamber 12. The dispensing chamber 12 may contain liquid contents which remain in the dispensing chamber until the closure is opened and removed from the container neck 30. The dispensing chamber 12, as shown, provides a sealed area in order to maintain the purity and prevent premature mixing of the contents thereof and the contents within the container.

Figure 3:
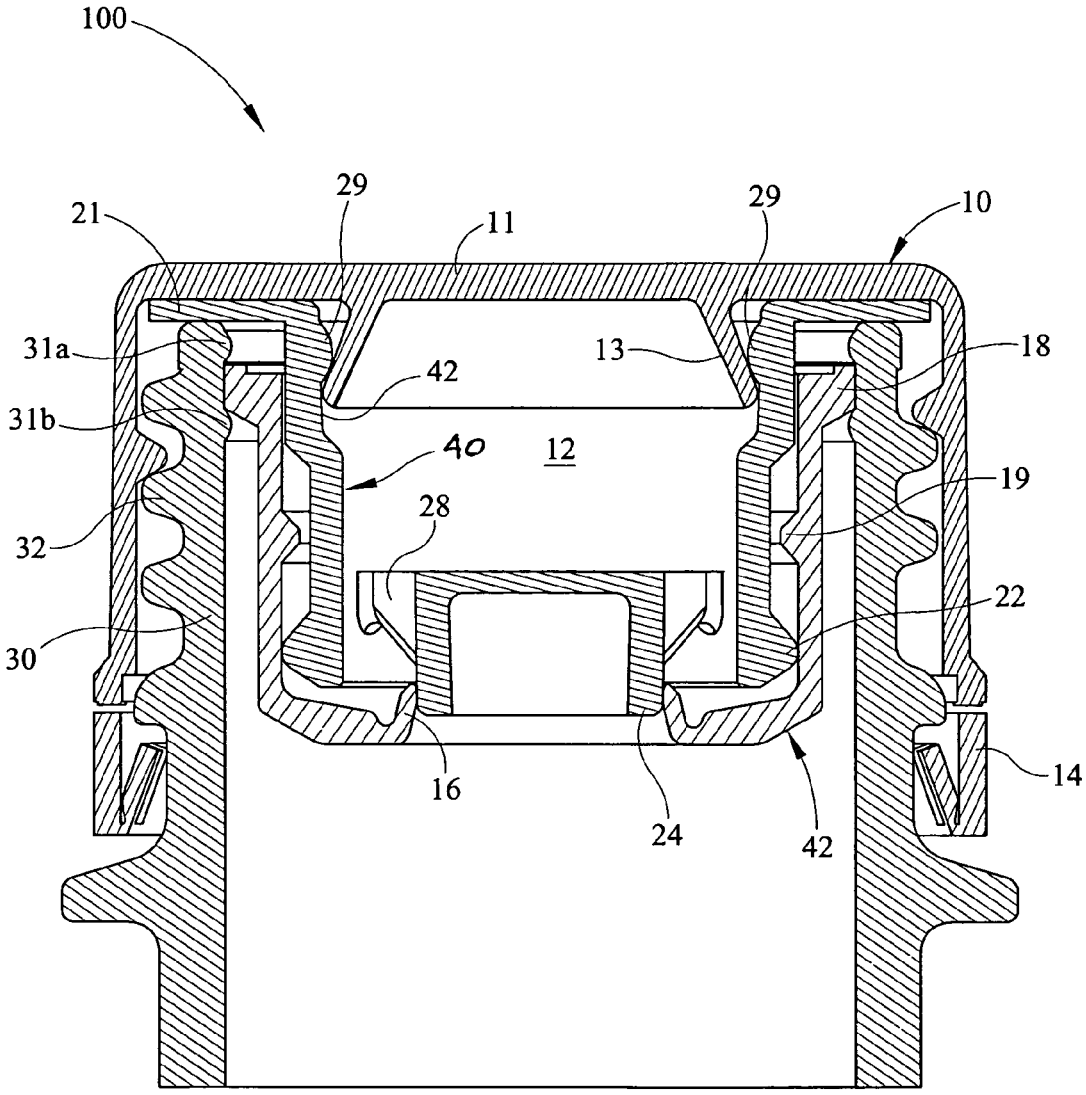
FIG. 3 is a side sectional view of the combined closure of the present invention after installation.

As shown in the drawings of FIG. 3, the insert 40 contacts a top wall seal 13 to prevent the contents contained within the dosing chamber 12 from leaking up or around the insert top wall 21 and the top wall of the closure 11. The top wall seal 13 may be an outwardly flared depending seal which contacts a rib or small abutment on the inner wall of the insert side wall 20 to provide adequate sealing surface contact. Further, the insert side wall 20 may have along a lower edge thereof an insert button 22 which contacts an inner side wall of the button 42 to provide additional sealing off of the dosing chamber 12 while also providing lateral movement between the insert 40 and the button 42.

As shown in FIG. 3, the top wall seal 13 depends downward from the top wall 11 of closure 10. The top wall seal 13 may be an annular seal and may have an outward flare, for example as shown, although many other known embodiments are available for use. In combination with the depending top wall seal 13 is an insert 40, as seen in the figures, which is retained in engagement with the closure 10 by the interference contact between outward flared seal 13 and insert retention bead 29 which extends annularly about the upper portion of the insert side wall 20. A small vertical portion 42 in the interior side wall of insert 40 defines a potential vertical slide zone on which the insert 40 may vertically slide relative to the top wall 21 of the insert and the top wall 11 of the closure. This vertical slide zone 42 is positioned between the insert retention bead 29 and a step in the insert side wall 20 wherein the internal diameter of the side wall is greater along the vertical slide zone 42 as opposed to lower portion of the insert 40 along which the insert externally engages the button 42, button 42 described in detail herein. The inward step provides clearance for engagement of the inwardly directed button bead 19 against the outer side wall of insert 40.

The insert retention bead 29 may be any of a number of structures from a continuous annular bead, an intermittent bead, engagement structure or other interference or engagement element to retain the closure 10 and the insert in slideable or non-moveable contact.

Figure 4:
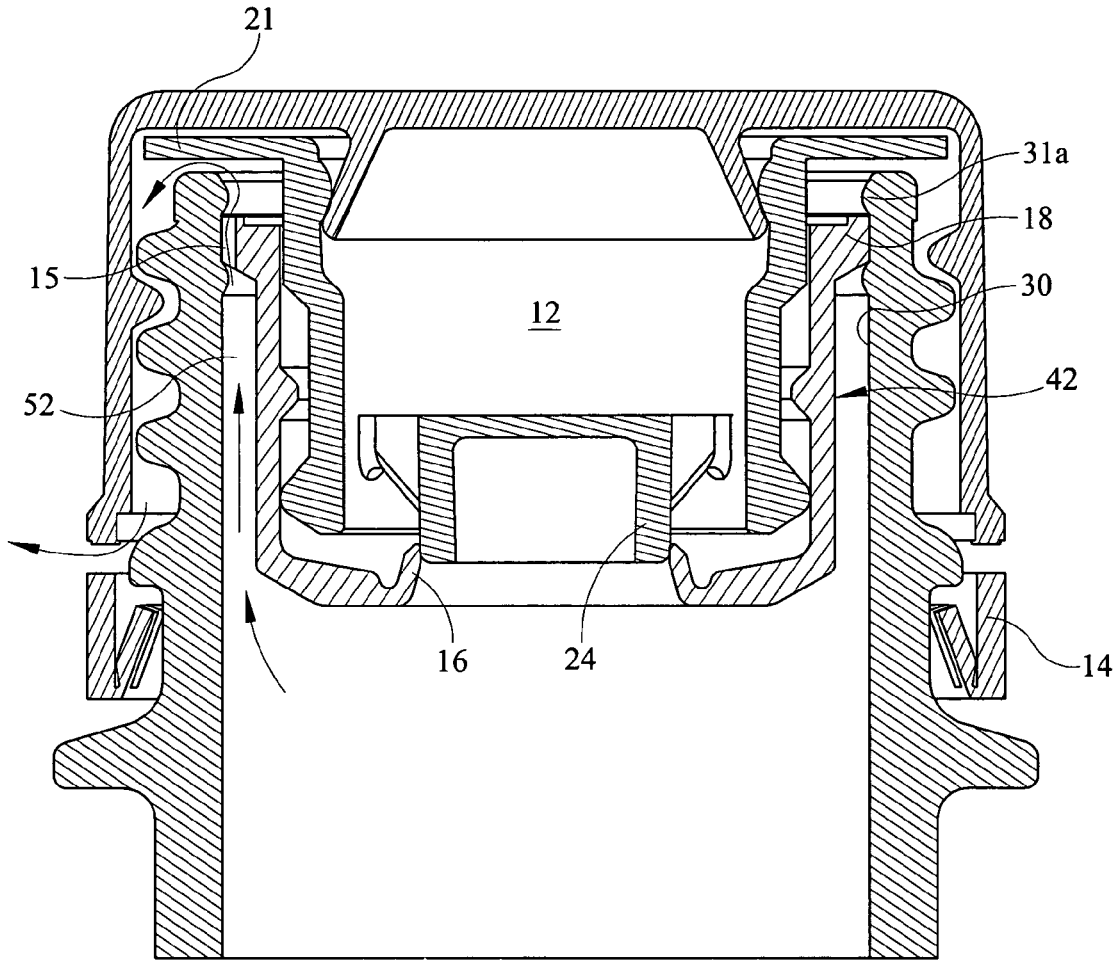
FIG. 4 is a side sectional view of the combined closure of the present invention upon initial release of the pressurized contents of the container.
Figure 5:
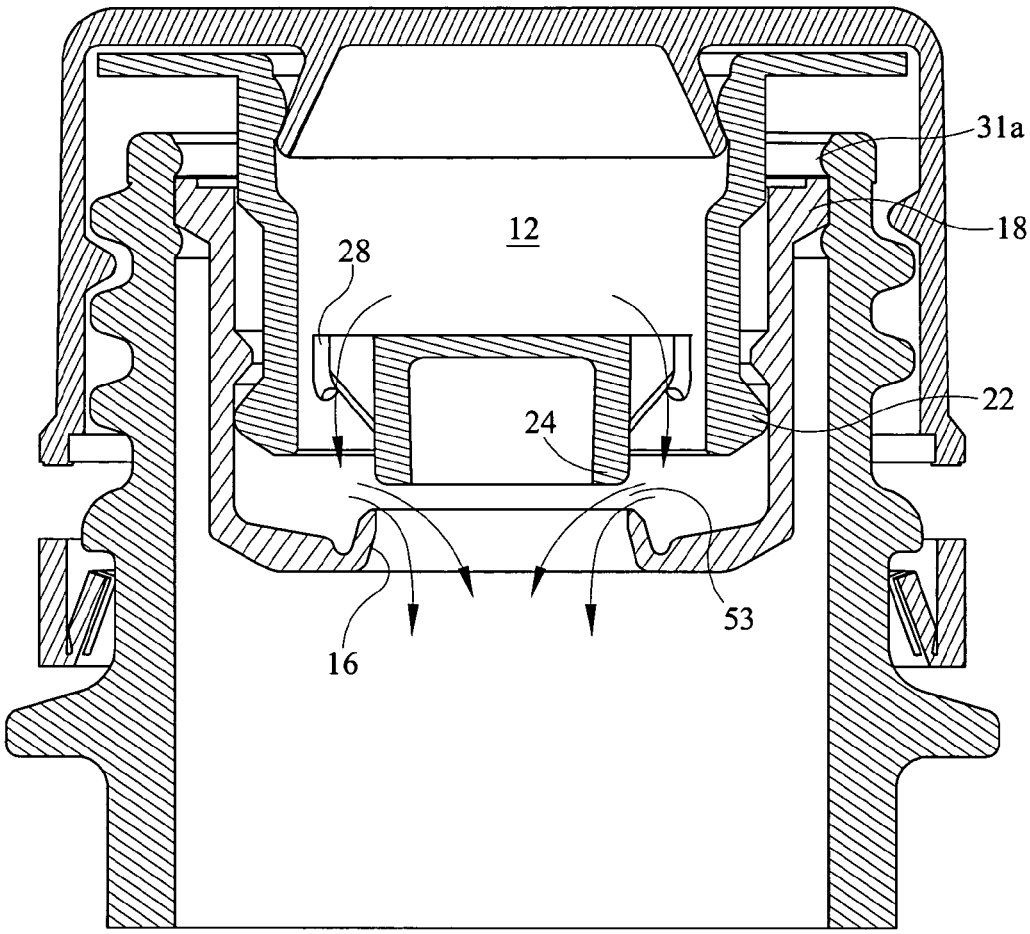
FIG. 5 is side sectional view of the combined closure of the present invention upon release of the contents within the dosing chamber.
Figure 6:
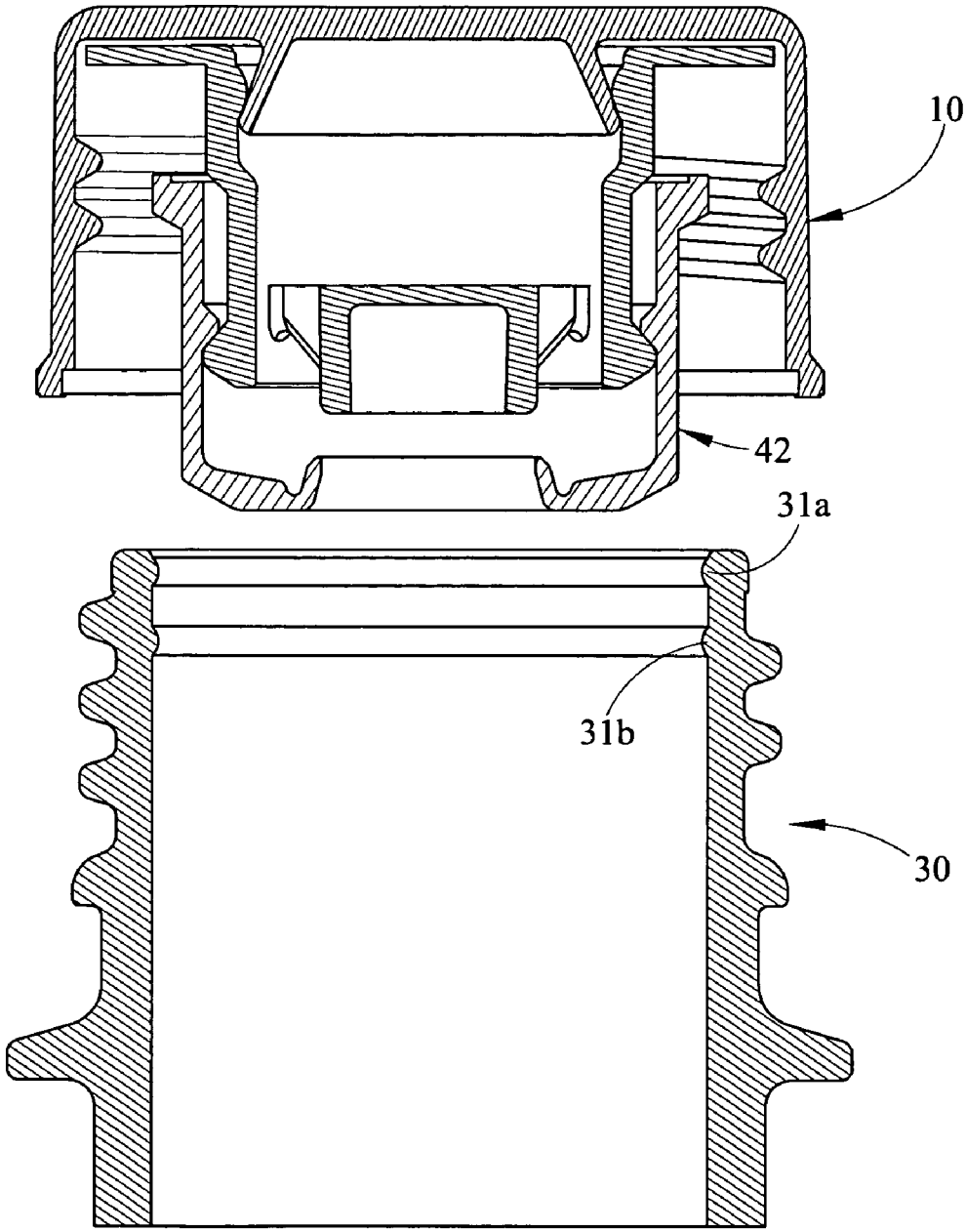
FIG. 6 is a side sectional view of the closure of the present invention after complete removal of the closure from the container neck.

A gap may form between the top wall 21 of the insert and the top wall 11 of the closure 10 as is seen in FIGS. 4 and 5 when the closure 10 is pulled upward from the container side wall 30. However, it is not required and can be designed around or prevented. The mechanism by which the closure 10 and the insert 40 interface and engage may be varied significantly in order to provide a proper resistive engagement or retaining engagement between the two structures. Further, a single piece structure may be utilized in order to prevent utilization of multi-piece structures.

The insert side wall 20 defines an interior dosing chamber 12 which can contain fluid or other material or additive for insertion into the container upon opening of the closure for the first time. The dosing chamber 12 may be pressurized or non-pressurized and is sealed to prevent material leakage out of the dosing chamber 12 into the container or between the closure and insert 40. Additive in the dosing chamber 12 is inserted into the container upon initial separation of the closure from the container, the additive flowing between the insert sidewall 20 and the center bore insert 24. The center bore insert 24 is held in place centrally within the insert by a plurality of support ribs 28 which extend inwardly from sidewall 20. The support ribs 28 suspend the center bore insert 24 centrally and internally within insert 40 and provides a guided flow path 53, shown in FIG. 5, for additive to follow.

The center bore insert 24 provides a surface for sealing engagement between button 42 and insert 40 effective sealing off the dosing chamber 12 and maintaining the additive material therein until dosing of the additive is required. The lower portion of the center bore insert 24 contacts button seal 16 to seal the dosing chamber. Button seal 16 may be a pliable annular seal which sealingly engages the center bore insert 24, as shown. Additive material is maintained within the dosing chamber 12 due to the seal 16 and is released upon upward travel of the insert 40 relative to the button 42, as is shown in FIG. 5. A number of known sealing mechanisms may be utilized between the two structures in order to maintain the sealing engagement mentioned or in or order to seal the dosing chamber 12, the embodiment shown being one example of such a structure.

As can be seen in FIG. 5, closure 10 and insert 40 move together upon unthreading of the closure on container threads 32. Upon initial vertical upward movement of the closure and insert, insert bead 22 travels upward interiorly of the button 42 disengaging the button seal 16 from the center bore insert 24 thereby releasing the additive material. The outer diameter of the insert bead 22 is such that it interferes with button bead 19 when the insert is pulled upward by closure 10. This interference or engagement between the insert bead 22 and the button bead 19 represents the maximum floating vertical travel distance of the insert within the button wherein continued upward travel of the closure/insert combination is translated to the button 42 thereby causing the button to become disengaged from the interior side wall 30 of the container.

The button is maintained in position within the interior side wall 30 of the container by the upper container bead 31*a* and lower container bead 31*b* which lock the button retention bead 18 therebetween. However, the inward dimension of the upper container bead 31*a* is such that button retention bead 18 may travel over the upper bead 31*a* with sufficient upward force which is met by removal of the closure from the container. Thus, initial removal of the closure from the container causes vertical sliding movement between the insert 40 and button 42 since button 42 is maintained in position within the container throat. This initial separation between the insert 40 and button 42 disengages the button seal 16 from the center bore insert 24 allowing the contents of the dosing chamber 12 to flow through flow path 53 shown in FIG. 5. Continued upward travel of the closure 10 on the container side wall threads 32 pulls the closure 10 and insert 40 further upward such that the free travel limit of the insert 40 within the button 42 is met due to the interference between insert bead 22 and button bead 19. Once this free travel limit is met, the continued vertical movement is translated to the button 42 causing the button 42 to move upward. Button retention bead 18 overcomes the resistance implied to restrict vertical travel by upper container bead 31*a* and the button 42, insert 40 and closure 10 can be removed from the container. Further, the contents of the dosing chamber 12 are emptied into the container prior to removal of the closure from container.

The combined multi-piece closure 10 of the present invention may be utilized with pressurized container contents, such as carbonated beverages. In use with pressurized contents, seal 16 may be biased upwardly as is shown in order to allow internal container pressure to more readily infiltrate dosing chamber 12. After the container is filled and capped, pressure within the container caused by the carbonation increases and can infiltrate the dosing chamber 12. Thus, the chamber 12 becomes pressurized with the additive contents. The multipiece closure 10 is designed to allow release of the internal container pressure first followed by opening of the dosing chamber 12 causing spraying of the additive through the flow path 53 due to pressurization of the dosing chamber.

In FIG. 4, initial release of the pressure within the container through pressure flow path 52 is depicted. Unthreading of the closure 10 from the container neck 30 separates the lower surface of the insert top wall 21 from the container rim. The button retention bead 18 may be notched, as depicted in the embodiment of FIG. 4, such that notch 15 provides a flow path to release the pressure within the container. Multiple notches or gaps 15 may be provided to provide adequate pressure release flow paths. This may work in combination with the pressure flow paths 55 formed in the container threads 32. Such initial release of the container pressure then creates a pressure difference between the dosing chamber 12 and the internal contents of the container. The pressure difference may then aid in ensuring the full dispensing of the container contents as depicted in FIG. 5. The pressure existent in the dosing chamber causes sudden release of the additive contents in the dosing chamber 12 once the center bore retention bead 24 is removed from contact with the sealing bead 16. Alternatively, this pressure difference may be used to trigger release of the additive into the container by use of a one way valve, biased seal flange 16 or other known mechanism to aid in dispersal of pressurized contents.

Button 42, as shown in FIG. 1 and the remaining sectional drawings, is part of the combined multi-piece closure 10 and forms a mechanism by which the contents of the dosing chamber may be released. Button 42 travels vertically upon insert side wall 20 above insert bead 22 and transition surface 57 on the exterior side wall of the insert 40. This vertical travel distance allows the contents of the dosing chamber 12 to be released properly upon initial opening of the closure, whether the dosing chamber is pressurized or unpressurized.

The invention claimed is:

1. A multi-piece additive delivery closure system, comprising:

an overcap having a top wall and annular depending side wall;

a second annular side wall coaxial to and interiorly of said overcap side wall;

an annular center bore wall spaced interiorly of said second annular side wall;

a cup shaped button insert removably retained within a container neck and having a button seal surrounding a lower aperture, said button seal in sealing contact with said annular center bore wall;

wherein said second annular side wall defines a dosing chamber.

2. A multi-piece additive delivery closure system of claim 1 wherein said second annular side wall moves vertically within said cup shaped button insert.

3. A multi-piece additive delivery closure system of claim 2 wherein said vertical movement is defined by an interference between an inwardly directed button bead and an outwardly directed bead on said second annular side wall.

4. A multi-piece additive delivery closure system of claim 3 wherein said vertical movement causing contact between said button bead and said outwardly directed bead on said second annular wall creates a flow path from said dosing chamber through said lower aperture of said cup shaped button insert.

5. A multi-piece additive delivery closure system of claim 1 wherein said cup shaped button insert is removably retained in said container neck by a button retention bead on said cup shaped button insert resting between an inwardly directed upper and lower container bead.

6. A multi-piece additive delivery closure system of claim 1 wherein said second annular side wall is part of an insert.

7. A multi-piece additive delivery closure system of claim 6 wherein said insert has an annular top wall and a depending insert wall extending downward from an interior portion of said annular top wall.

8. A multi-piece additive delivery closure system of claim 1 wherein said overcap is threadably engaged to said container neck, said second annular side wall and said annular center bore wall substantially move with said overcap, said second annular side wall moving vertically within said cup shaped button insert allowing separation of said annular center bore wall from said button seal.

9. A multi-piece additive delivery closure system of claim 1 wherein said button seal has an annular side wall, said annular side wall having a vertical slide zone allowing limited vertical movement within said cup shaped button insert of said second annular side wall.

10. A multi-piece additive delivery closure system of claim 1 wherein said second annular side wall is an insert retained against said top wall of said overcap.

11. A multi-piece additive delivery closure system of claim 2 wherein said vertical movement is limited by an interference between an inwardly directed button surface and an outwardly directed surface on said second annular side wall.

12. A multi-piece additive delivery closure system of claim 3 wherein said vertical movement creates a flow path from said dosing chamber through said lower aperture of said cup shaped button insert.

13. A multi-piece additive delivery closure system of claim 1 wherein said cup shaped button insert is removably retained in said container neck by a button retention surface on said cup shaped button insert resting below an inwardly directed upper container bead.

14. A multi-piece additive delivery closure system of claim 1 wherein said cup shaped button insert is removably retained in said container neck by friction with a container bore bead.

15. A multi-piece additive delivery closure system of claim 1 wherein said cup shaped button insert is removably retained in said container neck and vertical downward movement is limited by a button retention bead on said cup shaped button insert resting above a container bead.

16. An additive dosing chamber defined within a multi-piece closure which dispenses upon initial removal of said multi-piece closure from a container neck, comprising:

a double shell closure having an outer side wall and an inner side wall depending from a top wall;

a container neck interposed between said outer side wall and said inner side wall;

a tertiary closure side wall interposed between said container neck and said inner side wall and forming a seal with a center bore, also having a vertical slide zone allowing limited vertical movement of said inner side wall relative to said tertiary closure side wall;

wherein said limited vertical movement disengages said seal and opening a flow path from a dosing chamber.

17. A multi-piece closure for adding material into a container comprising:

a closure having a top wall and depending side wall, said top wall having a depending top wall seal;

an insert having an annular top wall and an insert side wall, said top wall seal extending into said insert and retaining said insert top wall adjacent said closure top wall, said insert having a center bore insert suspended therein by a plurality of support ribs;

a button having a button bead removably retained within said container by a button retention bead frictionally retained between an upper container lip bead and a lower container lip bead, a button seal extending inwardly against said center bore insert, said insert vertically slidable within said button;

said insert defining a dosing chamber interiorly thereof and sealed by said button seal, said button seal disengaging said center bore insert upon vertical movement of said closure and said insert, wherein further vertical movement of said closure and said insert allows said button bead to override said upper container lip bead.

* * * * *

UNITED STATES PATENT AND TRADEMARK OFFICE

CERTIFICATE OF CORRECTION

PATENT NO. : 7,588,142 B1
APPLICATION NO. : 11/283601
DATED : September 15, 2009
INVENTOR(S) : Randall G. Bush It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 867 days.

Signed and Sealed this

Twenty-first Day of September, 2010

David J. Kappos

David J. Kappos
*Director of the United States Patent and Trademark Office*